United States Patent [19]

Ojanen

[11] Patent Number: 4,743,069

[45] Date of Patent: May 10, 1988

[54] ROTATABLE CUTTING BIT

[75] Inventor: Randall W. Ojanen, Bristol, Tenn.

[73] Assignee: GTE Products Corporation, Stamford, Conn.

[21] Appl. No.: 39,838

[22] Filed: Apr. 17, 1987

Related U.S. Application Data

[63] Continuation of Ser. No. 713,711, Mar. 19, 1985, abandoned.

[51] Int. Cl.[4] ..... F21C 25/12

[52] U.S. Cl. ..... 299/86; 299/91

[58] Field of Search ..... 299/79, 86, 91, 92; 24/297, 17 AP

[56] References Cited

U.S. PATENT DOCUMENTS

| | | | |
|---|---|---|---|
| 3,397,012 | 8/1968 | Krekeler | 299/92 |
| 3,663,063 | 5/1972 | Johnmeyer, Sr. | 299/86 |
| 4,149,753 | 4/1979 | Stoltz et al. | 299/91 |
| 4,484,783 | 11/1984 | Emmerich | 299/92 X |
| 4,497,520 | 2/1985 | Ojanen | 299/86 |

FOREIGN PATENT DOCUMENTS

| | | | |
|---|---|---|---|
| 2041289 | 9/1980 | United Kingdom | 299/92 |
| 2105768 | 3/1983 | United Kingdom | 299/79 |

*Primary Examiner*—Stephen J. Novosad
*Assistant Examiner*—David J. Bagnell
*Attorney, Agent, or Firm*—Robert E. Walter

[57] ABSTRACT

A cutter bit includes an elastomeric end cap compressibly held in a base of a bit holder whereby forward movement of the bit in an axial direction is restricted but the bit is free to rotate.

1 Claim, 1 Drawing Sheet

ROTATABLE CUTTING BIT

This is a continuation of application Ser. No. 06/713,711 filed on Mar. 19, 1985, now abandoned.

FIELD OF THE INVENTION

The present invention relates to a rotatable cutting bit of the type having a head portion and depending shank.

BACKGROUND OF THE INVENTION

Bits that are used in mining and for removing road surfaces are typically mounted in a machine having a power driven cutter wheel. The wheel has an array of cutter bits mounted on the rim which attack the material to be broken.

It is desirable to have the bits rotate in their sockets to permit wear on the bit to be distributed evenly so as to maintain sharpness.

U.S. Pat. No. 4,149,753 describes a cutter bit having a shank with a reduced diameter held in a bore by a bearing ring. A compressible locking ring surrounds and grips the bearing ring so that the locking ring frictionally engages the bore in the bit holder to restrain relative axial movement between the cutter bit and the holder. An exposed and of the bit shank projects rearwardly of the block and rotates relative to the block. Thus, cuttings and dust which might wedge between the block and shank act to hinder rotation.

SUMMARY OF THE INVENTION

According to the present invention, the cutter bit is secured against axial withdrawal while the open end of the bore holding the shank of the cutter bit is sealed to prevent the entrance of fine materials into the bore which might hinder rotation. The seal is such that the rotating end of the shank is not exposed and the seal is stationary with respect to block.

In accordance with the present invention, there is provided a cutter bit comprising a forward head portion having rearwardly depending cylindrically shaped shank adapted to be received in a bore of a bit holder, said head having a forwardly projecting cutting insert mounted therein and an enlarged section adapted to prevent movement of said head portion into the bore, said shank having a reduced section at the rearward end forming a shoulder and being concentric with a main portion of said shank, said reduced section including a circumferential ridge projecting outwardly in the radial direction, an end cap mounted on said reduced section, said cap including an integral ridge projecting inwardly and overlapping said circumferential ridge whereby forward motion along the axial direction of said shank with respect to said cap is opposed.

DRAWINGS

DETAILED DESCRIPTION OF THE INVENTION

Figure 1:
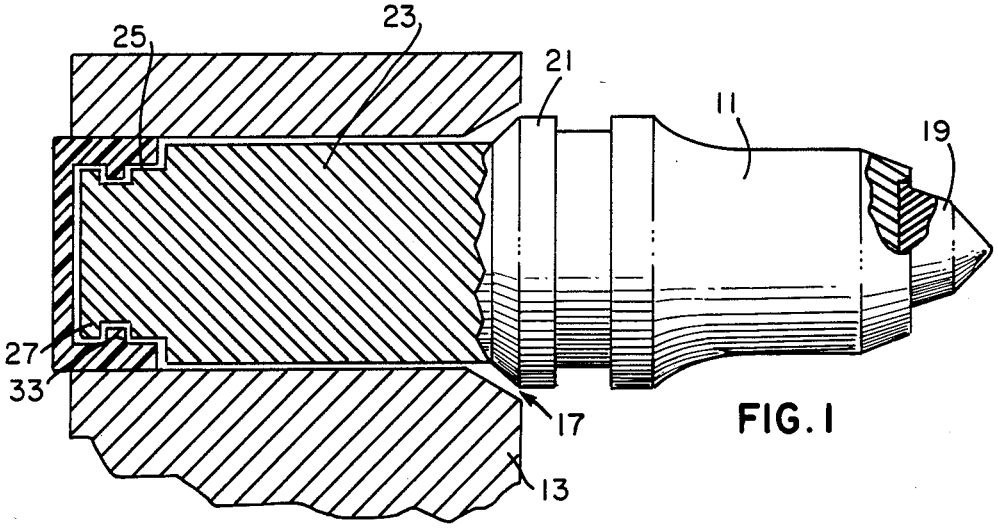
FIG. 1 is a partially sectioned view of a cutter bit mounted in a holder with a cap.
Figure 3:
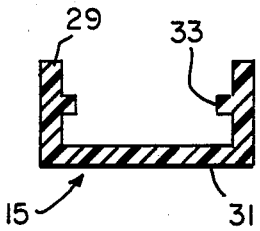
FIG. 3 is a cross-sectional view along section 3—3 of FIG. 2.
Figure 2:
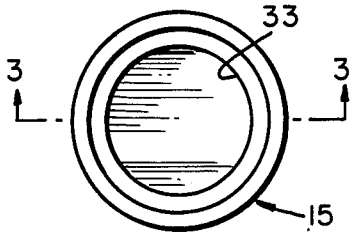
FIG. 2 is an end view of the cap.

Referring to the drawings, FIG. 1 shows a bit 11 mounted in a bit holder 13 for rotation about a longitudinal axis. The head portion of the bit is at the forward end and a cap 15 is positioned at the rearward end for retaining the bit 11 in the bore 17 of the bit holder 13.

For purposes of description, the term inwardly means in a radial direction toward the longitudinal axis and outwardly means in a radial direction away from the longitudinal axis. Forwardly means along an axial direction toward the forward end of the bit and rearwardly means along an axial direction toward the rearward end of the bit.

The bit 11 of the present invention is rotably held in a bore 17 in a bit holder 13 so as to resist rearward forces in the axial direction when the bit 13 engages the material to be cut. The cap 15 permits the bit to be removed by an appropriate force in the forward direction. Due to the fact that the cap 15 remains stationary with respect to the bit holder 13 and is compressibly mounted internal to the bore 17, entry of debris and dust into the bore 17 is prevented.

A hard insert 19 typically made of a metal carbide material may be secured by brazing in a socket at the forward end of the head portion. Rearwardly of the insert 19, the head portion includes an enlarged section 21, which is larger than the bore 17 of the bit holder 13 and prevents or limits the rearward motion of the bit 11. By having the enlarged section 21 appropriately spaced a specific distance from the cap 15, it is not necessary for the cap 15 to function to resist rearward forces in the axial direction on the bit 11 which occur during cutting. These forces are borne by the enlarged section 21.

Rearwardly of the enlarged section 21, the bit 13 includes a depending shank 23 having a main cylindrical section smaller than the diameter of the bore. Interior the bore 17, a reduced cylindrical section 25 of the shank forms a shoulder with the main cylindrical section. Spaced rearwardly from the shoulder, the reduced cylindrical 25 section includes a circumferentially ridge 27 projecting outwardly from the peripheral surface.

The cap 15 is mounted on the rearward end of the shank 23 interior the bore 17 and is interposed between the shank 23 and the bit holder 13. The cap 15 has a cylindrical wall 29 forming an opening at one end for receipt of the shank 23 and is closed at the other end by bottom 31. The inner peripheral surface of the wall 29 includes an inwardly projecting circumferential ridge 33. The ridge 33 is engageable with the aforementioned ridge 27 of the shank 23 to prevent forward movement of the bit 11 along the axial direction. Thus, forces causing the bit 11 to move forwardly are transmitted to the cap 15. Preferably the cap 15 is positioned so that rearward forces on the bit 11 are not transmitted to the cap 15.

The inner surface of the wall 29 is adjacent the reduced section of the shank 23 so that the frictional engagement there between is such that the bit 11 is freely rotatable in the bit holder 13. The outer surface of the wall 29 compressibly engages the bit holder 13 along the surface of the bore 17 due to the diameter of the cylindrical wall 29 being slightly larger than the bore 17. Thus, forward forces on the bit 11 along the axial direction are resisted and the bit 11 tends to remain in the bore 17. The primary compressive force on the cap 15 is in the area where the cylindrical wall 29 joins the bottom 31. In this area, the bottom 31 resists radial compressive forces against the wall 29, while at the open end of the cap 15, the wall 29 tends to spring inwardly due to a compressive force and the radial holding forces are not as great.

The retention forces exerted by the cap 15 on the bit 11 should not be sufficient to permit withdrawal of a bit 11 during use but permit withdrawal of the bit 11 for installation of new bits. During typical use, the bit holders 13 are mounted about the periphery of a cylinder and the cylinder is rotated into work so that the primary forces tend to urge the bit into holder 13 or block. Such use may include mining or planning asphalt or concrete roads. Typically the bit may be pryed from the block with a tool. The cap 15 of the present invention tends to seal the bore from the entry of the dirt which might cause undue wear or make extraction of the bit more difficult.

The ridge 33 engages complimentary ridge 27 to create a force, hereinafter called shank retention force relative to the cap 15. The cap 15 engages the inner surface of the bit holder 15 in the bore 17 to create a force, hereinafter called cap retention force, the resist the forward movement of the cap relative to the bit holder 13. Either or both forces may act to retain the bit in the bit holder against a forward force. Both forces are dependent on the nature of the cap material which is preferably a tough elastomeric material. For comparable shapes, the more elastomeric the cap 15, the less forces created. For a particular elastomeric material, the retention forces are dependent on the shape of the cap 15 and the complimentary shape of the bore 17. The shank retention force is dependent on the engagement of the ridge 33 with ridge 27. If the complimentary ridges 27 and 33 overlap to a greater extent or interlock to a greater extent the shank retention force becomes greater. The cap retention is dependent on the compressible force exerted in the radial direction against the bit holder 13 by the cap 15. Wider diameter caps tend to exert a greater compressible force. If the shank retention force is greater than the cap retention force, the cap 15 tends to remain captive on the bit 11 as the bit 11 is removed from the bit holder 15. If the cap retention force is greater than the shank retention force, the cap 15 tends to remain captive in the bore 17 of the bit holder 13 as the bit 11 is removed from the bit holder 13. Both embodiments of the present invention may be utilized.

What is claimed is:

1. A cutter bit assembly comprising a forward head portion having rearwardly depending cylindrically shaped shank adapted to be received in a cylindrical bore of a bit holder, said head having a forwardly projecting cutting insert mounted therein and an enlarged section adapted to prevent movement of said head portion into the bore, said shank having a reduced section at adjacent the rearward end forming a shoulder and being concentric with a main portion of said shank, said reduced section including a circumferential ridge projected outwardly in the radial direction, said circumferential ridge being spaced rearwardly from said shoulder at the end of said shank, and end cap mounted for free rotation on said reduced section, said end cap formed of an elastomeric material and having a closed bottom covering the rearward end of said shank, forwardly projecting cylindrical wall depending from said closed bottom, said cylindrical wall having an inner and outer surface, said inner surface being contiguous said reduced section of said shank to permit free rotation of said bit relative said end cap, said outer surface having a slightly larger diameter than the diameter of said cylindrical bore and extending substantially along the entire axial length of said end cap whereby rotational forces and forward forces on said bit along the axial direction are resisted by said end cap, said cylindrical wall portion including an integral ridge projecting inwardly and overlapping said circumferential ridge whereby forward motion along the axial direction of said shank with respect to said cap is resisted.

* * * * *